United States Patent [19]

Broeker et al.

[11] Patent Number: 4,905,845

[45] Date of Patent: Mar. 6, 1990

[54] DISPLAY UNIT

[75] Inventors: Herbert H. Broeker, Overland Park, Kans.; John W. Lewman, Kansas City, Mo.

[73] Assignee: Hallmark Cards, Incorporated, Kansas City, Mo.

[21] Appl. No.: 311,630

[22] Filed: Feb. 16, 1989

[51] Int. Cl.[4] ..... A47F 7/00

[52] U.S. Cl. ..... 211/55; 211/128

[58] Field of Search ..... 211/50, 55, 52, 128

[56] References Cited

U.S. PATENT DOCUMENTS

| | | | |
|---|---|---|---|
| 240,246 | 4/1881 | Fuller | 211/50 X |
| 1,247,033 | 11/1917 | Swartz | 211/50 X |
| 1,433,414 | 10/1922 | Quin | 211/50 X |
| 2,333,717 | 11/1943 | Heed et al. | 211/55 X |
| 4,613,047 | 9/1986 | Bushyhead et al. | 211/128 X |

*Primary Examiner*—Alvin C. Chin-Shue
*Assistant Examiner*—Sarah A. Lechok
*Attorney, Agent, or Firm*—Neuman, Williams, Anderson & Olson

[57] ABSTRACT

A novel display unit adapted for attachment to an article display panel having at least one horizontally extending display compartment defined by a vertically extending wall, particularly display panels having a number of rows of the display compartments arranged in overlapping step-like fashion which precludes full view of articles displayed in each row. The display unit is attachable to one or more of such stepped overlapping display compartments to provide for full-face display of articles. The display unit is formed of a transparent material and has a generally U-shaped cross-sectional configuration defined by spaced vertically extending front and back walls connected by a substantially horizontal bottom wall. The back wall is provided with outwardly extending curved lip portions at the upper and lower ends thereof to form a track for slidable reception of a selected background member. The bottom wall of the unit has spaced legs depending therefrom whereby said display unit can be engaged with a vertically extending wall of a display compartment.

2 Claims, 1 Drawing Sheet

FIG. 1
PRIOR ART
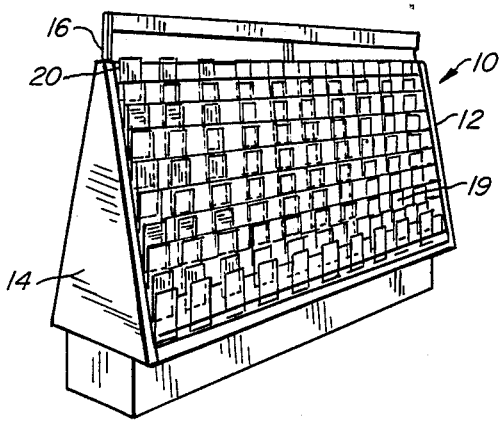
FIG. 2
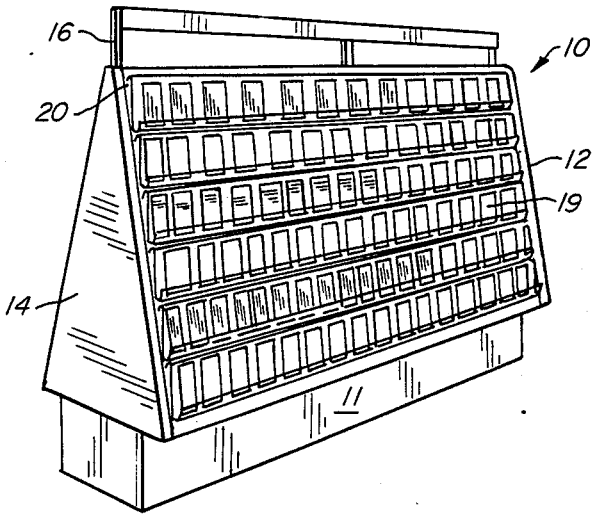
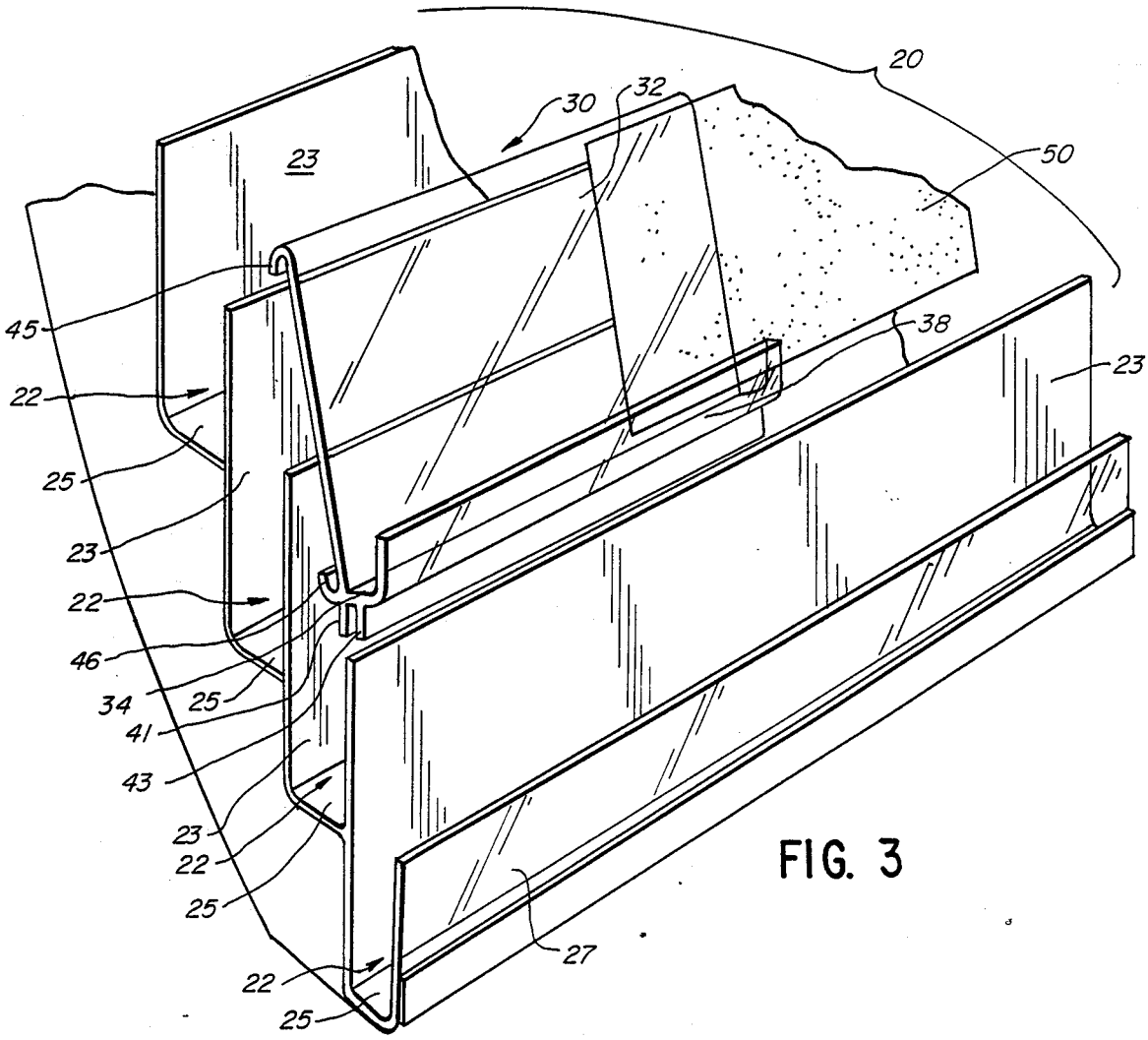
FIG. 3

DISPLAY UNIT

This invention relates to merchandise display and more particularly to a display unit for use in displaying cards, pamphlets, bulletins and the like.

BACKGROUND OF THE INVENTION

Articles such as greeting cards are commonly displayed in racks having a number of horizontal rows of display compartments. Usually the horizontal display compartments are arranged in terraced or step-like manner with the displayed articles such as greeting cards extending upwardly so as to overlap and conceal the lower portion of cards in the next upper row. Such arrangements are in many instances satisfactory, but frequently it is desirable to display articles such as greeting cards in a manner such that the entire greeting card is visible to the customer.

OBJECTS OF THE INVENTION

It is therefore an object of this invention to provide a display unit which can be easily attached to stepped display compartments so as to provide for full-face display of the articles.

It is another object of the invention to provide a full-face display unit which can be removably attached to one or more rows of a stepped display assembly to provide full-face display of the articles against a selected background.

DETAILED DESCRIPTION OF THE DRAWINGS

FIG. 1 is a perspective view of a typical stepped prior art displace rack showing a number of greeting cards disposed therein.

FIG. 2 is a perspective view of a display rack embodying the display unit of the invention.

FIG. 3 is a partial perspective view of an article display panel having a plurality of horizontal display compartment arranged in overlapping step-like fashion and the manner in which a display unit in accordance with the invention is attached thereto.

SUMMARY OF THE INVENTION

The present invention provides a novel display unit which is adapted for attachment to an article display panel having at least one horizontally extending display compartment defined by a vertically extending wall. Usually the article display panel involves a number of rows of the display compartments arranged in overlapping step-like fashion which precludes full view of articles displayed in each row. The display unit of this invention is attachable to one or more of such stepped overlapping display compartments to provide for full-face display of articles such as greeting cards and the like. The display unit is formed of a transparent material and has a generally U-shaped crosssectional configuration defined by spaced vertically extending front and back walls connected by a substantially horizontal bottom wall. The back wall is provided with outwardly extending curved lip portions at the upper and lower ends thereof to form a track for slidable reception of a selected background member. The bottom wall of the unit has spaced legs depending therefrom whereby said display unit can be engaged with a vertically extending wall of a display compartment.

DESCRIPTION OF THE PREFERRED EMBODIMENTS

FIG. 1 is a perspective view of a typical display assembly 10 which, as shown, comprises a free-standing support structure 11 composed of side walls 12 and 14 and a back wall 16 to provide an open front display housing. Completing the display assembly 10 is a stepped front display panel 20 comprised of a plurality of horizontally extending display compartments 22 having vertically extending back walls 23 and substantially horizontal bottom walls 25. The bottom walls 25 are joined to the vertically extending back wall 23 of the next lower compartment to form the generally U-shaped display compartments 22. The lowermost display compartment 22 is provided with a vertically extending front wall 27.

The stepped display panel 20 is preferably formed of thin, light-weight, rigid materials such as metals or plastic, e.g., acrylic plastics, and can be opaque or transparent. The panel 20, including the display compartments 22, can be produced in one piece by suitable extrusion or molding techniques. Such a stepped display panel 20 is widely used to display items such as greeting cards, calendars, notepads and the like. It is seen (FIG. 1) that the displayed items 19 in each display compartment are not completely visible, with the lower portion of the item being hidden or obscured by either the upstanding back wall 23 of the next lower display compartment 22 if such is not formed of a transparent material or by virtue of the height of the displayed items 19 in the next lower display compartment.

The size and number of the display compartments 22 can be varied depending upon the desired size of the display and the size of the articles to be displayed. Thus, for example, for displaying greeting cards, the back wall 23 of the display compartments 22 can be say 6 inches in height and the width of the bottom wall 25 can be say 1 inch. The overall width of the display panel 20 can be varied as desired and can be formed in sections so that a number of display panels 20 can be arranged in side-by-side relationship to form the overall display assembly.

In accordance with this invention, a novel display unit is attached to a conventional stepped display panel which displays articles in overlapping, partially obscured relationship so as to afford a full-face view of the displayed articles. A full-face display unit 30 in accordance with this invention is partially shown in FIG. 3. The full-face display unit formed preferably of a transparent material such as an acrylic plastic is formed with a vertically extending back wall 32, a substantially horizontal bottom wall 34 and a short vertical front wall 38. Depending downwardly from the bottom wall 34 are spaced legs 41 and 43 which form therebetween an inverted U-shaped channel 45. Preferably, but not necessarily, the channel 45 extends the entire width of the full-face display unit 30 and is of a width such as to fit over and engage the upper edge of the vertically extending back wall 23 of the next lower display compartment 22 as illustrated in FIG. 3. The back wall 32 of the full-face display compartment 30 has an outwardly projecting curved upper lip 45 and an outwardly projecting curved lower lip 46. Together the complementary lips 45 and 46 form a track for slidable insertion of an appropriate background slide 50. The background slide 50 can be formed of any suitable material, such as metal, plastic or paperboard, and can be of any desired color or it can carry any appropriate indicia or ornamentation so as to enhance the aesthetics of the display, particularly when the supply of displayed articles in the full-face display unit is exhausted.

In order to avoid overlapping and to provide full view of the articles to be displayed, one or more full-face display units 30 can be appropriately spaced in vertical direction on the stepped display panel. Thus, depending upon the size of the articles to be displayed in each full-face display unit 30, such units can be attached to every other stepped display compartment 22 or every third such compartment, etc. For example, with a display panel having thirteen rows of stepped display compartments 22, six removable full-face display units 30 can be utilized on every other row of display compartments 22. Any desired number of full-face display units can be employed so as to provide full-face display for the entire display assembly or for any portion thereof.

Card divider of spacer elements such as shown in U.S. Pat. Nos. 4,613,047 and 3,892,450 can be positioned at desired intervals within the display units 30 to separate articles on display. The card dividers enhance the structural strength of the unit and can be formed of any suitable lightweight material such as an extruded or molded plastic.

The support structure for the display assembly can take various forms and can be of simple construction. For example, as disclosed in U.S. Pat. No. 4,613,047, one single framework can serve as the essential support structure.

The display unit of the invention provides for full view display of articles utilizing existing conventional stepped overlapping display racks. It is adaptable to existing display racks of various sizes, is easily and economically manufactured in desired dimensions and can be used repeatedly to embrace an entire display assembly or a desired portion thereof. The new display unit permits a desired background to be inserted therein to enhance and set off a particular display article.

Those modifications and equivalents which fall within the spirit of the invention are to be considered a part thereof.

What is claimed is:

1. A display unit adapted for attachment to an article display panel having at least one horizontally extending display compartment defined by a vertically extending wall, said display unit being formed of a transparent material and having a generally U-shaped crosssectional configuration defined by spaced vertically extending front and back walls connected by a bottom wall, the back wall having outwardly extending curved lip portions at the upper and lower ends thereof to form a track for slidable reception of a background member, said bottom wall having spaced legs depending therefrom whereby said display unit can be engaged with a vertically extending wall of a display compartment.

2. In combination, an article display panel having a plurality of horizontally extending display compartments disposed in overlapping step-like fashion and attached to at least one such display compartment a removable transparent display unit for full view display of articles therein, said display unit being formed of a transparent material and having a generally U-shaped cross-sectional configuration defined by spaced vertically extending front and back walls connected by a bottom wall, the back wall having outwardly extending curved lip portions at the upper and lower ends thereof to form a track for slidable reception of a background member, said bottom wall having spaced legs depending therefrom whereby said display unit can be engaged with a vertically extending wall of a display compartment.

* * * * *